United States Patent [19]

Wagaman et al.

[11] 4,145,384

[45] Mar. 20, 1979

[54] HUMIDIFIER

[75] Inventors: Neil D. Wagaman, Liverpool, N.Y.; Hatcher R. Meeks; Donald E. Alexander, both of Knoxville, Tenn.

[73] Assignee: Carrier Corporation, Syracuse, N.Y.

[21] Appl. No.: 815,321

[22] Filed: Jul. 13, 1977

[51] Int. Cl.[2] ..... B01F 3/04

[52] U.S. Cl. ..... 261/35; 261/29; 261/30; 261/36 R; 261/97; 261/106; 261/DIG. 15

[58] Field of Search ..... 261/30, 35, 36 R, 92, 261/103, 104, 106, 107, DIG. 15, DIG. 46, 97, 110, 29; 126/113

[56] References Cited

U.S. PATENT DOCUMENTS

| | | | |
|---|---|---|---|
| 1,181,886 | 5/1916 | High | 261/30 |
| 2,435,798 | 2/1948 | Rice et al. | 261/35 X |
| 2,631,023 | 3/1953 | Bailey | 261/92 X |
| 2,693,947 | 11/1954 | Dean | 261/92 X |
| 3,189,328 | 6/1965 | Hotchkiss et al. | 261/DIG. 46 |
| 3,193,259 | 7/1965 | Liebmann | 261/106 X |
| 3,199,846 | 8/1965 | Durham et al. | 261/106 X |
| 3,266,784 | 8/1966 | Saito | 261/92 X |
| 3,298,676 | 1/1967 | Moore | 261/35 |
| 3,395,900 | 8/1968 | Meek | 261/29 |
| 3,421,745 | 1/1969 | Prupis | 261/35 |
| 3,479,801 | 11/1969 | Yamasaki | 261/92 X |
| 3,481,588 | 12/1969 | Lobb | 261/92 X |
| 3,744,773 | 7/1973 | Velander | 261/DIG. 15 |
| 3,747,904 | 7/1973 | Gross | 261/92 |

*Primary Examiner*—Richard L. Chiesa
*Attorney, Agent, or Firm*—J. Raymond Curtin; John S. Sensny; Donald F. Daley

[57] ABSTRACT

An evaporator type humidifier in which a fan wheel is rotated by an air stream and drives a water wheel. The water wheel lifts water from a water receptacle to a water distribution system. The water distribution system can collect water and then distribute a substantially equal amount of water to each air-water contact member in the humidifier. The amount of water distributed to each contact member is sufficient to wet the contact member and inhibit the formation of deposits on the contact member by flushing away minerals and other solid particles.

1 Claim, 5 Drawing Figures

HUMIDIFIER

BACKGROUND OF THE INVENTION

This invention relates to a new and improved gas and liquid contact apparatus, and more specifically, to an evaporator type humidifier for use with a water source and a flowing air stream.

Humidifier devices as now used commercially are usually one or the other of two broad types: the evaporator type in which an air-water contact member is wetted with water and exposed to an air stream, and the air stream is humidified by the molecular transfer of water into the airstream by evaporation; and the atomizer type which sprays water into the air stream in fine particles or droplets by spray nozzles, centrifugal atomizers, or similar devices. In evaporator type humidifiers, minerals and other solid particles in the water tend to remain on the contact members and form deposits as the air stream evaporates the water. These deposits detrimentally affect the performance of the humidifier because, among other reaons, they obstruct the flow of air through the contact members.

Prior art devices such as the ones disclosed in U.S. Pat. No. 3,395,900 granted to G. W. Meek on Aug. 6, 1968, and U.S. Pat. No. 3,481,588 granted on Dec. 2, 1969, to O. J. Lobb show that a thorough flushing of the contact members will inhibit the formation of deposits by washing away a considerable portion of the solid particles that would otherwise accumulate and form deposits. Both of these devices, however, require an outside power source to accomplish the flushing. Other prior art humidifiers are powered by the air stream flowing through the humidifier and do not require any outside power source. One is disclosed in U.S. Pat. No. 3,421,745 granted on Jan. 14, 1969, to R. I. Prupis and another is disclosed in U.S. Pat. No. 3,744,773 granted to H. W. Velander on July 10, 1973. These U.S. Patents appear to be the closest known prior art.

The present invention is an improvement on the prior art because it accomplishes a thorough flushing of air-water contact members in a manner powered solely by the air stream flowing through the humidifier. Both the Prupis humidifier and the Velander humidifier produce a relatively steady spray of water, but neither humidifier provides a contact member or what could be considered as a contact member with a supply of water, as the present invention does, sufficient to inhibit the formation of deposits on the contact member.

Flushing the contact members clean of solid particles that would otherwise accumulate and form deposits on the contact members increases the efficiency of the humidifier and reduces the frequency of the time-consuming, periodic cleaning the humidifier requires. This is particularly desirable for humidifiers designed for residential use. Eliminating the need for an outside power source makes the humidifier simpler, safer, and less expensive to manufacture, operate, and maintain. There is, for example, no need for an electric motor and its concomitant costs. In addition to achieving the above, the humidifier of the present invention, in contradistinction to many prior art devices, flushes the contact members clean with only a minimal consumption of water. This too makes the humidifier simpler and less expensive to operate.

SUMMARY OF THE INVENTION

The primary objective of this invention is to provide a low-cost, effective humidifier with no electrical connections or power requirements.

Another objective of this invention is to provide an evaporator type humidifier which effectively inhibits the tendency of minerals and other solid particles to form deposits on the contact members by intermittently and thoroughly flushing the contact members clean of these solid particles in a manner that consumes a minimal amount of water and is powered solely by the air stream flowing through the humidifier.

These and other objectives are achieved by a new and improved evaporator type humidifier appratus which is used with a water source and a flowing air stream. The flushing of the contact members is accomplished by means of a fan wheel and a flushing system that is connected to the fan wheel through a suitable drive system. The fan wheel is mounted so that it is rotated by the air stream flowing through the humidifier, and the flushing system is capable of intermittently supplying the contact members with an amount of water sufficient to inhibit the formation of deposits on the contact members. In a preferred embodiment the flushing system is comprised of a water distribution system which regulates the amount of water flowing over the contact members and from where water can flow by gravity over the contact members, and water lifting means driven by the fan wheel to supply the water distribution system with water from a water receptacle.

Further benefits and advantages of the invention will become apparent from a consideration of the following description given with reference to the accompanying drawings which specify and show a preferred embodiment of the invention.

A DETAILED DESCRIPTION OF A PREFERRED EMBODIMENT

Figure 1:
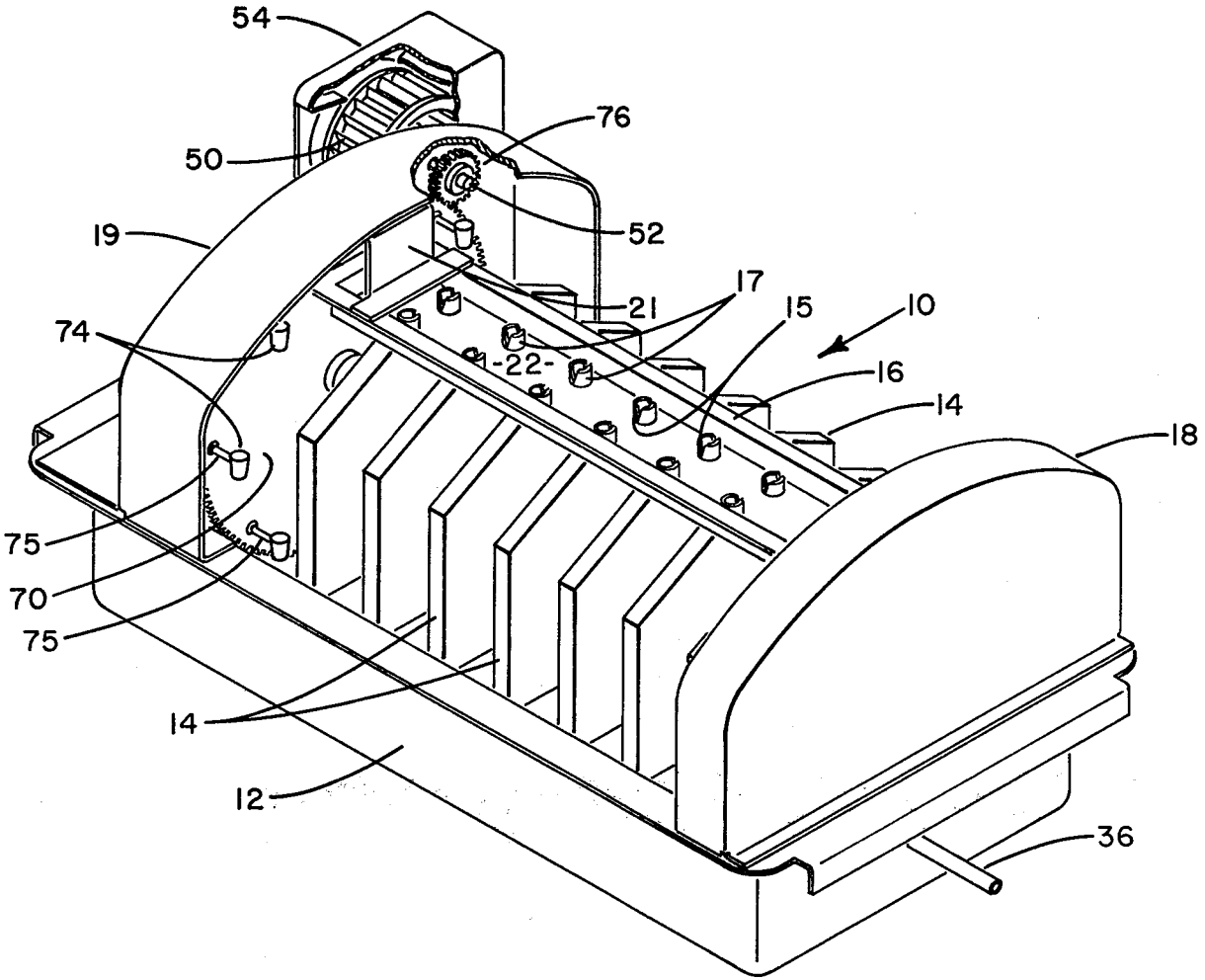
FIG. 1 is a perspective view of a humidifier constructed according to the present invention with portions broken away to show the internal gearing arrangement and the fan wheel.
Figure 3:
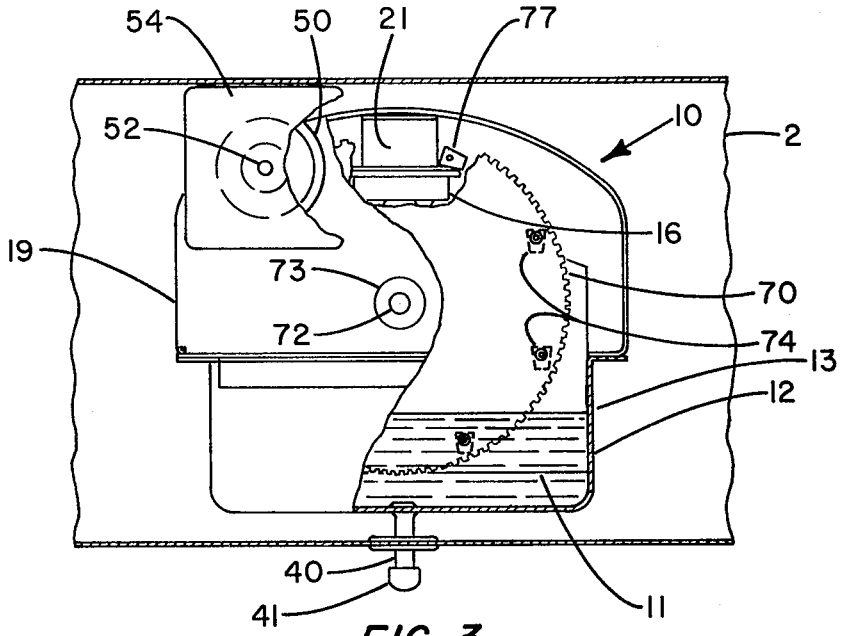
FIG. 3 is a left end view taken along line III—III of FIG. 2 with portions of the humidifier broken away.
Figure 2:
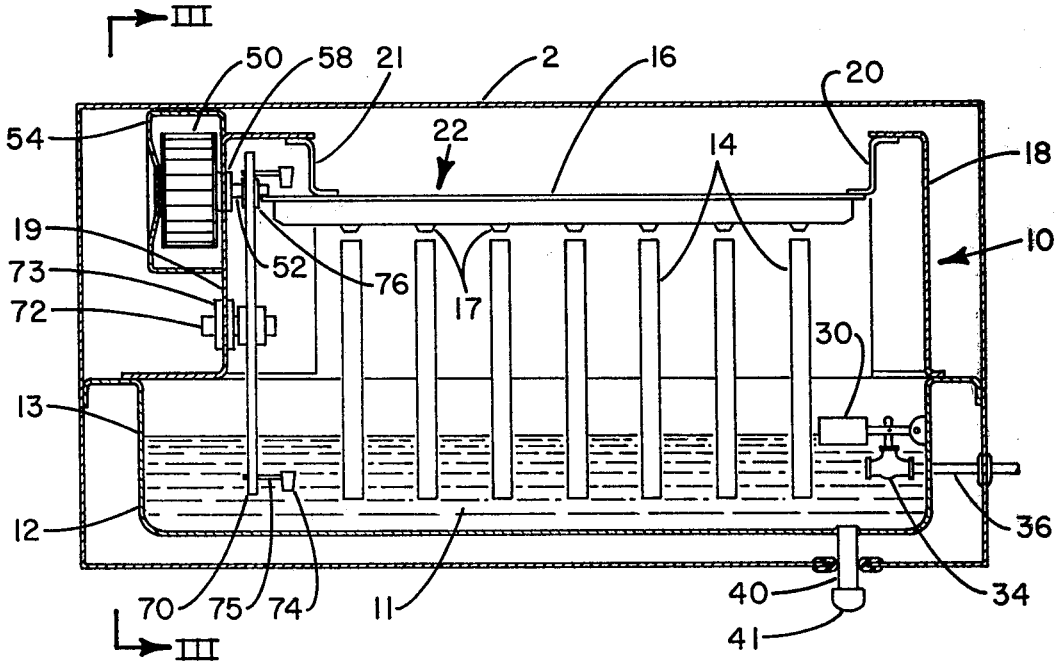
FIG. 2 is a side sectional view of the humidifier of FIG. 1 with the humidifier mounted in a horizontal forced air duct with the air duct shown in cross section.

Referring now to the drawings, and particularly to FIGS. 1 through 3, there is illustrated a humidifier apparatus generally designated 10 suitable for installation in a horizontal duct run 2 of a heating or air conditioning system. The size of the duct run 2 relative to the humidifier 10 is unimportant so long as the duct 2 is of sufficient size to accommodate the humidifier 10 without appreciably affecting the overall air flow through the duct 2. The humidifier 10 is positioned so that its longitudinal axis and the axis of rotation of the fan wheel 50 to be described is generally perpendicular to the direction of the air flow through the duct 2.

The humidifier apparatus 10 includes a water receptacle or reservoir 12 containing a supply of water 11 rising to a predetermined level 13. The water receptacle 12 also contains a float 30 which controls a valve 34 to a water conduit 36 which is connected to a water source (not shown). The float 30 controls the valve 34 in a manner known by those skilled in the art so as to maintain the water 11 in the water receptacle 12 at the desired level 13. The water receptacle 12 is provided with a drain 40 and a drain cap 42 for draining the water receptacle 12 of silt, lime, and other foreign matter. The humidifier 10 also includes a series of air-water contact members 14, and end frame members 18 and 19 which are mounted on the longitudinal ends of the water receptacle 12 and extend above the contact members 14.

In a preferred embodiment the contact members 14 are made of moisture absorbent or bibulous material such as cellulose or asbestos paper, and preferably are impregnated with a substance such as phenol or melamine resin. The impregnation is calculated to give these contact members 14 the desired wet strength while still maintaining their bibulous characteristics. Other types of contact members 14 are known by those skilled in the art and may be used in the humidifier 10 of the present invention. Also, the contact members 14 in the illustrated embodiment are stationary and are positioned substantially vertical with their faces generally parallel to the air flow in the duct 2. The contact members 14 extend above the top of the water receptacle 12 and expose enough surface area to the air stream flowing through the humidifier 10 to allow for sufficient evaporation of water from the contact members 14 into the air stream. In addition, the contact members 14 extend into the water 11 in the water receptacle 12. It should be understood that this particular shape and spatial arrangement of the contact members 14 is not necessary to the present invention. Other shapes and spatial arrangements are known in the prior art and may be used with the present invention. Specifically, it is not necessary to the present invention that the contact members 14 extend into the water 11 or that the contact members 14 be stationary. They may be entirely above the water 11 contained in the water receptacle 12 similar to the contact members disclosed in the Meek patent referred to above, and they may be rotated as are the ones in the humidifier apparatus disclosed in U.S. Pat. No. 3,298,676 granted Jan. 17, 1967, to R. J. Moore wherein the contact members are rotated through a water receptacle and into an air stream.

A water distribution system designated generally as 22 extends above the contact members 14 so that water can flow by gravity from the water distribution system 22 over the contact members 14. The water distribution system 22 includes a water trough 16 that is substantially horizontal, is generally parallel to the longitudinal axis of the humidifier 10, and is connected to end frame member 18 by bracket 20 and to end frame member 19 by bracket 21. The water distribution system 22 also includes a plurality of tubes 17. Each tube 17 extends from slightly below the bottom of the water trough 16, through the bottom of the water through 16 to slightly above the bottom of the water trough 16. Vertical V-notches 15 are constructed in the sides of the tubes 17, and each notch 15 extends upwards from the bottom of the water trough 16 to the top of a tube 17. In a preferred embodiment two tubes 17 are directly above each contact member 14, and each such pair of tubes 17 has a total of three V-notches 15 constructed in them.

The tubes 17, since they extend through the bottom of the water trough 16 and are spatially arranged so that two tubes 17 are directly above each contact member 14, allow water to flow from the water trough 16 over the contact members 14. Since the tubes 17 also rise above the bottom of the water trough 16, they act as shallow dams allowing water to accumulate throughout the water trough 16. As the water trough 16 is substantially horizontal, the water accumulates substantially evenly throughout the water trough 16. Water can accumulate throughout the water trough 16 until it reaches a height where the surface tension of the water can no longer prevent gravity from pulling the water through the V-notches 15 in the tubes 17. When this occurs, the surface tension of the water breaks and essentially all of the water in the water trough 16 flows through the V-notches 15, through the tubes 17, and over the contact members 14. Because the water accumulates substantially evenly throughout the water trough 16, a nearly equal amount of water flows through each V-notch 15, and each contact member 14 is provided with a substantially equal amount of water.

The height at which water starts to flow out of the water trough 16 is determined by the acuteness of the angle made by the sides of the V-notches 15 as these sides meet at the bottom of the water trough 16. The more acute this angle, the higher the water can accumulate in the water trough 16 before the surface tension of the water can no longer prevent gravity from pulling the water through the V-notches 15. Thus, the V-notches 15 comprise a water regulation system to cause enough water to accumulate in the water distribution system 22 so that when water does flow from the water distribution system 22 over the contact members 14 a sufficient amount of water flows over the contact members 14 to, one, wet them so that water can evaporate from the contact members 14 into the air stream, and, two, flush them clean of minerals and other solid particles that would otherwise form deposits on the contact members 14. These solid particles and excess water are collected in the water receptacle 12. Other types of water distribution systems and water regulation systems are known by those skilled in the art and may be used with the humidifier 10 of the present invention.

A fan wheel 50 is mounted on one end of an axle 52 so that they are rotatable unitarily. A fan wheel shroud 54 is attached to end frame member 19, partially covers the fan wheel 50, and serves to guide air to the fan wheel 50. The other end of the axle 52 extends through and is rotatably supported by a bearing block 58 secured to end frame member 19. The axle 52 is generally parallel to the longitudinal axis of the humidifier apparatus 10 so that the air stream which is flowing through the duct 2 rotates the fan wheel 50 and the axle 52.

A water wheel 70 is mounted on an axle 72. Axle 72, which extends through the water wheel 70, also extends through and is rotatably supported by a bearing surface 73. Bearing surface 73, in turn, is secured to end frame member 19. A series of cups 74 are pivotally attached to the water wheel 70 at equal circumferential spacings by rods 75. Each cup 74 is attached to a rod 75 at a point which is above the center of gravity of the cup 74 when it is filled with water and above the center of gravity of the cup 74 when it is empty, so that the cups 74 tend to remain in an upright position regardless of whether they contain water or are empty. As the water wheel 70 rotates, the cups 74 pass through the water 11 in the water receptacle 12, and each cup 74 picks up water from the water receptacle 12. In the illustrated embodiment, the lower portion of the water wheel 70 is immersed in the water 11 in the water receptacle 12. It should be understood that it is not necessary to the present invention that the water wheel 70 extends into the water 11. For example, if the cups 74 were pivotally attached to L-shaped rods which were rigidly secured to the water wheel 70 so that the circle traversed by the cups 74 as the water wheel 70 rotated was larger than the circumference of the water wheel 70, then the cups 74 could pass through the water 11 in the water receptacle 12 without having the water wheel 70 extend into the water 11.

The edge of the water wheel 70 contains gear teeth and is drivingly engaged with a gear 76 which is mounted on the fan wheel axle 52 so that the gear 76 rotates with the fan wheel axle 52. Rotation of the fan wheel 50, thus, causes rotation of the water wheel 70. For a fan wheel 50 rotational speed of from 400–600 rotations per minute, the water wheel 70 rotates at a speed of from 2–3 rotations per minute. This relatively low water wheel 70 speed keeps drag forces on the cups 74 to a minimum as they pass through the water 11 and reduces spillage and splashing while still providing a sufficient water lift rate. End frame member 19 partially encloses the water wheel 70 and the cups 74 to shield them from the air stream flowing through the humidifier 10. Without this shield the air stream might, among other things, tend to pivot the cups 74 about the rods 75 causing water to prematurely spill out of the cups 74.

As the fan wheel 50 rotates, the water wheel 70 rotates and carries the cups 74 through the water 11 so that at one point in its course the top of each cup 74 is below the water level 13 and the cup 74 fills with water. The water wheel 70 continues to rotate and the cups 74 are carried up and past the water trough 16. Since the center of gravity of the cups 74 when they are filled with water is below the point at which they are attached to the rods 75, the cups 74 remain in an upright position and water does not spill out of the cups 74 as the cups 74 are carried up towards the water trough 16. As the water wheel 70 carries the cups 74 past the water trough 16, the water trough 16 strikingly engages the cups 74 below the point at which the cups 74 are attached to the rods 75 causing the cups 74 to pivot about the rods 75 as shown at 77 in FIG. 3. The radius of the cups 74 is slightly less than the shortest distance between the line about which the cups 74 pivot, as they are strikingly engaged by the water trough 16, and the water trough 16. This allows the cups 74 to move, albeit in a pivoted position, past the water trough 16, but still requires the cups 74 to pivot almost ninety degress from the vertical as they pass the water trough 16. This causes water in the cups 74 to spill into the water trough 16 as the cups 74 are carried past the water trough 16 by the water wheel 70. As explained above, a predetermined amount of water can collect in the water trough 16 and then this water can flow by gravity from the water trough 16 over the air-water contact members 14 wetting them and flushing them clean. The solid particles flushed off the contact members 14 and excess water are collected in the water receptacle 12.

Figure 4:
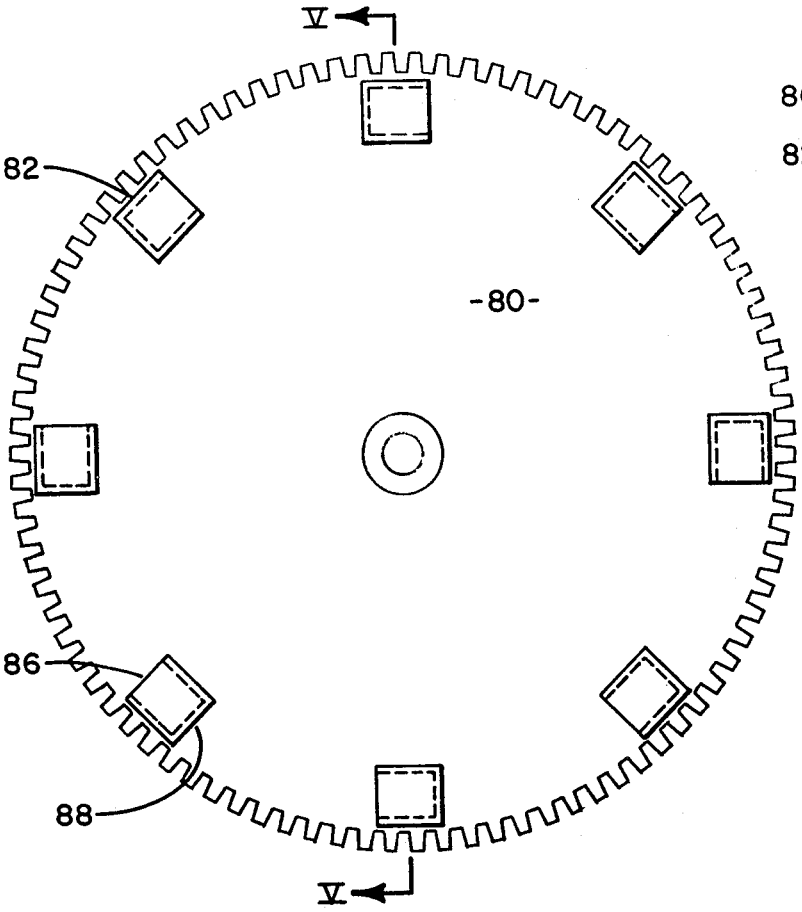
FIG. 4 is a view of an alternate embodiment of a water wheel usable in the humidifier shown in FIGS. 1 through 3.
Figure 5:
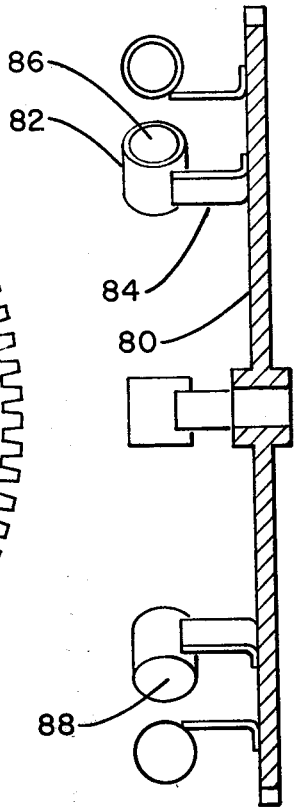
FIG. 5 is a sectional view of the water wheel of FIG. 4 taken along line V—V of FIG. 4.

FIGS. 4 and 5 show an alternate embodiment of a water wheel 80 usable in the humidifier 10 of the present invention. A series of cups 82 are rigidly attached to the water wheel 80 at equal circumferential spacings by brackets 84. When the water wheel 80 is used in the humidifier 10 of the present invention, the cups 82 are carried into and out of the water 11 in the water receptacle 12 by the water wheel 80 as the water wheel 80 rotates. The cups 82 are positioned so that as they are carried into the water 11 the open ends 86 of the cups 82 contact the water 11 before the closed ends 88 of the cups 82 contact the water 11, and so that as the cups 82 are carried out of the water 11 the open ends 86 of the cups 82 exit the water 11 before the closed ends 88 of the cups 82 exit the water 11. Thus, as the cups 82 pass through the water 11 they pick up water, and as the cups 82 are carried out of the water 11 they are partially filled with water with the amount of water in the cups 82 being dependent upon the water level 13 in the water receptacle 12. The water wheel 80 continues to rotate and the cups 82 are carried up and past the water trough 16. As the cups 82 are carried up, as can be seen from FIG. 4, the angle between the sides of the cups 82 and the vertical increases and, eventually, water spills out of the open ends 86 of the cups 82. The water 11 in the water receptacle 12 is maintained at a low enough level 13 so that the cups 82 do not pick up so much water, as they pass through the water 11, that water spills out of the cups 82, as they are carried up by the water wheel 80, until the cups 82 are above the water trough 16.

While the specific humidifier apparatus 10 described utilizes cups 74 or 82 attached to a water wheel 70 or 80 to lift water from the water receptacle 12 to the water distribution system 22, it is also contemplated that other means to lift water may be used. For example, water may be lifted by means of cups secured to a revolving chain. Also, while the specific humidifier apparatus 10 described utilizes a drive system including a water wheel 70 or 80 with an edge that contains gear teeth and is drivingly engaged with a gear 76 rotated by the fan wheel axle 52, it is also contemplated that other drive systems may be used. For example, a drive system which incorporates a belt instead of a gear may be used.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. A humidifier for use with a water source and a flowing air stream including:

a water receptacle for containing water;

a water conduit to connect the water receptacle to the water source;

water control means to maintain the water in the water receptacle at a predetermined level;

at least one gas-liquid contact member wherein water is evaporated from the contact member into the air stream and excess water from the contact member flows into the water receptacle;

a water distribution system positioned above the contact member wherein water flows by gravity from the water distribution system over the contact member, for collecting water and regulating the flow of water over the contact member so that an amount of water sufficient to clean the contact member intermittently flows thereover;

a fan wheel positioned in the flowing air stream so that it is rotated thereby;

a fan wheel shroud covering the fan wheel for guiding air thereto;

at least one cup for carrying water from the water receptacle to the water distribution system;

a water wheel powered by rotation of the fan wheel for supporting the cup for movement between the water receptacle and the water distribution system wherein the cup is pivotally attached to the water wheel above the center of gravity of the cup when it is filled with water and when it is empty, whereby the cup tends to stay in an upright position, and wherein, as the water wheel rotates, the cup passes below the predetermined level of water in the water receptacle and fills with water, and passes above the water distribution system;

tipping means to pivot the cup about its pivot point as the cup passes above the water distribution system for spilling water from the cup into the water distribution system;

a drive system connecting the fan wheel and the water wheel so that rotation of the fan wheel moves the cup between the water receptacle and the water distribution system; and a frame member for shielding the cup and the water wheel from the flowing air stream to prevent the air stream from causing the cup to lose water and to prevent the air stream from retarding movement of the cup and the water wheel.

* * * * *